US005975777A

United States Patent [19]

Nelson et al.

[11] Patent Number: 5,975,777

[45] Date of Patent: Nov. 2, 1999

[54] PRINTING APPARATUS WITH A SHUTTLE FOR MOVING THE PRINTING RIBBON

[75] Inventors: Michael Robert Nelson, Cambridge; Steven Carter, Nottingham, both of United Kingdom

[73] Assignee: Markem Technologies Limited, United Kingdom

[21] Appl. No.: 08/860,814

[22] PCT Filed: Jul. 29, 1996

[86] PCT No.: PCT/GB96/01844

§ 371 Date: Nov. 3, 1997

§ 102(e) Date: Nov. 3, 1997

[87] PCT Pub. No.: WO97/18089

PCT Pub. Date: May 22, 1997

[30] Foreign Application Priority Data

Nov. 13, 1995 [GB] United Kingdom ..... 9523174

[51] Int. Cl.[6] ..... B41J 33/14

[52] U.S. Cl. ..... 400/223; 400/229; 400/235

[58] Field of Search ..... 400/223, 224.2, 400/225, 229, 233, 218, 208, 235, 236, 283, 299, 93.19, 93.18, 93.21; 101/93.47

[56] References Cited

U.S. PATENT DOCUMENTS

| | | | |
|---|---|---|---|
| 1,133,004 | 3/1915 | Carlin | 400/303 |
| 2,098,878 | 11/1937 | Peters | 400/303 |
| 2,927,677 | 3/1960 | Saxby | 400/225 |
| 3,100,560 | 8/1963 | Kondur, Jr. | 400/225 |
| 3,726,381 | 4/1973 | Murphy | 400/208 |
| 4,157,224 | 6/1979 | Purzycki et al. | 400/233 |
| 4,378,566 | 3/1983 | Tsukamura | 358/503 |
| 4,598,301 | 7/1986 | Suzaki et al. | 347/214 |
| 4,632,582 | 12/1986 | Houston | 400/232 |
| 4,747,715 | 5/1988 | Lahr | 400/248.3 |
| 5,033,888 | 7/1991 | Okumura et al. | 400/208 |
| 5,156,474 | 10/1992 | Kurosawa et al. | 400/232 |
| 5,499,879 | 3/1996 | Meetze | 400/208 |

FOREIGN PATENT DOCUMENTS

| | | |
|---|---|---|
| 0 105 472 A2 | 4/1984 | European Pat. Off. . |
| 0 172 447 A1 | 2/1986 | European Pat. Off. . |
| 2 328 127 | 5/1973 | Germany . |
| 3 108 367 | 3/1981 | Germany . |

*Primary Examiner*—Edgar Burr
*Assistant Examiner*—Daniel J. Colilla
*Attorney, Agent, or Firm*—Fish & Richardson P.C.

[57] ABSTRACT

A printing apparatus for printing on a substrate, including a base mounting a storage spool for printing ribbon, a ribbon take-up spool, and there being a ribbon path from the storage to the take-up spool through a printing station, a print head relative to which the substrate and the ribbon move during a printing operation. The apparatus further including a shuttle moveable relative to the base, the shuttle having a ribbon guide about which the ribbon is entrained, the arrangement being such that relative movement between the print head and the ribbon is achieved by movement of the shuttle relative to the base.

16 Claims, 2 Drawing Sheets

PRINTING APPARATUS WITH A SHUTTLE FOR MOVING THE PRINTING RIBBON

This is a International Patent Application No. PCT/GB96/01844, with an international filing date of Jul. 29, 1996, now pending.

DESCRIPTION OF INVENTION

This invention relates to a printing apparatus and to a method of printing, and more particularly to a printing apparatus in which marking medium is carried on a ribbon which is fed along a ribbon feed path past a printing station from a storage spool onto a take-up spool.

The ribbon may for example be thermal transfer ribbon used in a thermal printing apparatus as described in detail in our previous published International Patent Application Number WO94/26526, or a simple inked ribbon or any other ribbon used in a printing process.

Presently there are a number of methods utilised in a thermal printing apparatus such as described in our previous International Patent Application Number WO94/26526, for achieving winding of the ribbon during and between printing operations.

A first known method of achieving ribbon winding is by directly driving the take-up spool to feed the ribbon along the ribbon feed path between the storage and take-up spools. Such an arrangement is mechanically relatively simple and reliable, which means that the solution is low cost. However, where it is desired to be able to advance the ribbon from the storage onto the take-up spool in accurate incremental amounts, this method has clear disadvantages in that the system to drive the take-up spool appropriately in order to advance to the ribbon a desired amount, is complex. Furthermore, when initially moving the ribbon it will be appreciated that it is necessary to move a substantially high mass, particularly that of the storage spool when almost full, as well as to overcome drag imposed along the feed path. This can result in the ribbon being stretched or even broken, particularly adjacent to the print head and/or a motor driving the ribbon to stall, and/or for undesirably long acceleration and deceleration times to be required for the drive motor, which is limiting the speed at which printing can be achieved.

Also it is difficult to achieve accurate incremental ribbon movements both when the rewind spool is empty, and as the rewind spool fills with ribbon from the storage spool.

Hence, complex and expensive controls are necessary to achieve proper operation of the simpler mechanical solution to the problem of ribbon winding.

A second known method of achieving ribbon winding is to drive the ribbon through the ribbon path between the supply and take-up spools by means of a drive roller assembly. Such a drive roller assembly still needs to move the mass of the ribbon storage spool, which of course will change as, the storage spool pays out ribbon, but the take-up spool may simply be arranged to receive ribbon slack as the drive roller assembly advances the ribbon.

Such a method is advantageous particularly where accurate incremental movements of ribbon are required as movement of the drive roller can achieve incremental ribbon movement which is not dependent at all upon the ribbon diameter on the take-up or storage spools. However, again a high standard of engineering is required to achieve accurate control of the drive roller and the take-up spool, with a resultant high cost.

According to a first aspect of the invention we provide a printing apparatus for printing on a substrate comprising a base mounting a storage spool for printing ribbon, a ribbon take-up spool, and there being a ribbon path from the storage to the take-up spool through a printing station, a print head relative to which the substrate and the ribbon move during a printing operation, wherein the apparatus comprises a shuttle moveable relative to the base, the shuttle having ribbon guide means about which the ribbon is entrained, the arrangement being such that relative movement between the print head and the ribbon is achieved by movement of the shuttle relative to the base.

Thus during a printing operation, at least take-up spool and preferably the storage spool too, may he maintained generally stationary and the relative movement between the ribbon and print head can be achieved solely by means of movement of the shuttle. Thus the need for slip clutches and the like through which to drive/drag the take-up and storage spools, to accommodate the changing diameters of the take-up and storage spools, is avoided.

In one arrangement, during a printing operation the print head is maintained generally stationary relative to the base, the shuttle being moveable relative to the print head and the base.

The ribbon guide means of the shuttle may comprise a pair of ribbon guides spaced apart a first distance, and the ribbon path may be around a pair of ribbon guides mounted on the base a second distance apart greater than the first distance, the ribbon guides of the base being arranged that such during a printing operation the shuttle moves between the ribbon guides of the base.

If desired, the ribbon path is around a further pair of ribbon guides mounted on the base and spaced apart a distance greater than the first distance, the shuttle being moveable between the first mentioned ribbon guides of the base and the further ribbon guides of the base.

In such an arrangement it will be appreciated that the length of ribbon which is traversed past the fixed print head during a printing operation, will be twice the distance the shuttle has to move to achieve that movement and that the ribbon will move at a speed exactly twice that of the shuttle.

When it is desired to advance the ribbon i.e. between printing operations such that fresh ribbon is available to move relative to the print head in a subsequent printing operation, the take-up spool may be rotated as the shuttle is moved in an opposite sense to the direction of movement of the shuttle during a printing operation.

Thus the take-up spool does not need to move the entire mass of the storage spool to achieve ribbon advance, but the storage spool is moved by virtue of the shuttle movement such that the take-up spool in effect, merely takes up ribbon already in the ribbon feed path.

Such a ribbon advance arrangement has been found greatly to reduce ribbon stretching and breakage compared with known arrangements in which the take-tip spool is responsible for advance of the ribbon through the ribbon feed path, and importantly, a constant load is imposed on the ribbon take-up spool drive motor, regardless of the respective diameters of the ribbon take-up and storage spools. Hence control of the drive motor is facilitated.

To enable an incremental amount of ribbon advance to be achieved between printing operations, preferably the length of ribbon fed during ribbon advance, is monitored. For example movement of the ribbon as it is paid out from the storage spool and/or fed onto the take-up spool, may be monitored by a suitable ribbon movement sensing means.

In another embodiment, the print head may be mounted on the shuttle so that during a printing operation, the substrate and the print head both move relative to the base. The print head and ribbon may move in the same sense of direction relative to the base, but at different speeds so as to achieve relative movement between the print head and the ribbon.

Utilising such an arrangement, the speed of the substrate onto which information can be printed is not limited to the operational speed of the print head but is restricted by the speed at which the print head can be moved relative to and in the same direction as the ribbon, including any time necessary to accelerate the print head up to a speed at which it may be operated.

The shuttle may comprise a pair of ribbon guides around which the ribbon is entrained, the guides of the pair being spaced apart a first distance and the ribbon path may comprise a pair of ribbon guides mounted on the base spaced apart a second distance less than the first distance.

During a printing operation, preferably shuttle movement is such that the pair of guides mounted on the base are always between the pair of ribbon guides of the shuttle. Again, in such an arrangement, the ribbon would always move at twice the speed, and twice the distance, than the shuttle.

In each embodiment, preferably prior to a printing operation, the print head is moved towards the substrate, and subsequent to the printing operation the print head is moved away from the substrate. For example, the print head may be moved, prior to and subsequent to a printing operation, along a direction traverse of the direction of movement of the shuttle.

If desired, after a first printing operation during which the shuttle moves from an initial to a final position relative to the base and marking medium is removed from a first area of the ribbon and transferred onto the substrate, the shuttle is moved back to the initial position without winding ribbon onto the takeup spool such that the first area of ribbon is moved back past the print head to where it was prior to the first printing operation, so that the first area of ribbon may be re-used during the following printing operation.

Of course, in the case where the print head is carried on the shuttle, the ribbon will be moved back past the print head at a speed greater than the speed of movement of the shuttle.

The printing apparatus may be a thermal type printing apparatus in which during a printing operation, pixels of marking medium are transferred from the ribbon onto the substrate by means of the print head which comprises a plurality of selectably energizable heating elements which are energized in use, where ribbon is re-used in a following printing operation, a first set of heating elements being energized during the first printing operation and a second set of the heating elements, which may or may not include heating elements of the first set, being energized in the following printing operation, such that pixels of marking medium are transferred from the first area of the ribbon onto the substrate during both of the printing operations.

According to a second aspect of the invention we provide a method of printing utilising a printing apparatus according to the first aspect of the invention, the method including the step of moving the shuttle relative to the base whilst performing a printing operation on the substrate, and maintaining at least the take-up spool generally stationary during the printing operation.

The invention will now describe with reference of the accompanying drawings in which.

Figure 1:
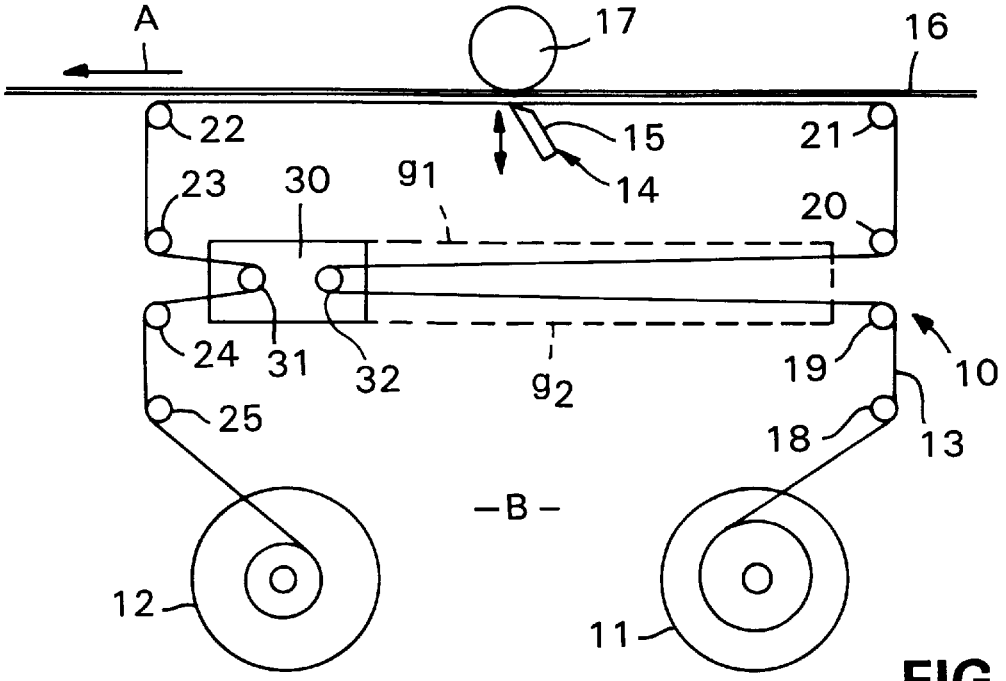
FIG. 1 is an illustrative view of a first embodiment of a printing apparatus in accordance with the invention, shown in a condition prior to a printing operation being performed.
Figure 2:
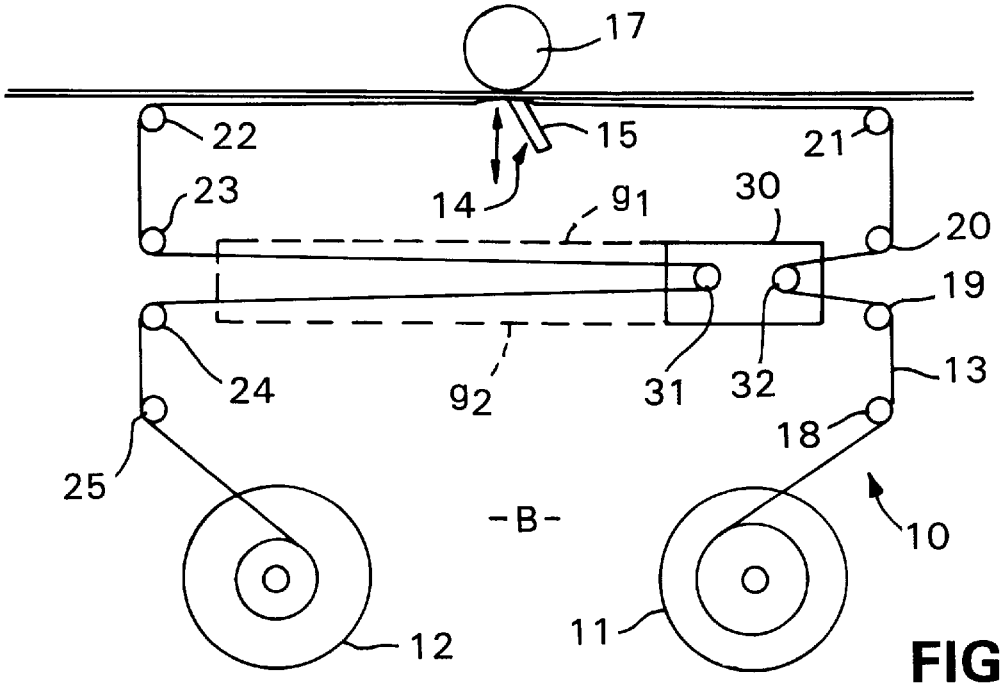
FIG. 2 is a view of the apparatus of FIG. 1 but shown in a condition immediately after a printing operation has been performed.

Referring first to FIGS. 1 and 2 there is shown a printing apparatus 10 comprising in this example a removable cassette, mounting a storage spool 11 for printing ribbon, and a take-up spool 12 for the printing ribbon, there being a ribbon path through the apparatus 10 between the storage 11 and take-up spool 12 for ribbon indicated at 13.

In this example, the ribbon 13 is of the so called thermal transfer type.

The ribbon path is through a printing station 14 (in this example not being part of the cassette) where a print head indicated at 15, is provided, the print head 15 having at an edge thereof, a plurality of selectably energizable heating elements each of which when energized, is operable to remove a pixel of print medium i.e. thermal transfer ink, from the ribbon 13, and transfer it onto a substrate which is indicated in the drawings at 16.

Selection of the heating elements is made by a computer or other control means, depending on what information it is required to print onto the substrate 16.

A backing roller 17 is provided (which is often referred to as the print roller), against which print head 15 bears, during a printing operation, to urge the ribbon 13 into close contact with the substrate 16.

Thermal transfer printing apparatus are in themselves well-known, a further detailed description of the operation of the heating elements of the print head 15, are not considered necessary.

The ribbon path includes a plurality of ribbon guides comprising in this example, rollers which are indicated at 18, 19, 20, 21, 22, 23, 24 and 25. Some or all of the rollers 18–25 and other components of the ribbon path may be integral with the cassette structure, or with the remainder of the apparatus 10, as desired. In each case, the cassette, where provided, and the remainder of the apparatus 10 provides a base B relative to which ribbon moves during a printing operation.

In accordance with the invention, the printing apparatus 10 includes a shuttle 30 which is provided with a pair of guide rollers 31 and 32 around which the ribbon is entrained. The shuttle 30 is provided between a pair of rollers 20 and 23 mounted on the base B, and a further pair of rollers 19 and 24, and is arranged to move relative to the base B, between the rollers 19 to 24, in a generally horizontal direction as seen in the drawings.

Roller 32 of the shuttle 30 receives ribbon which otherwise would pass directly from roller 19 to roller 20 at the right-hand side of the apparatus as seen in the drawings, whereas roller 31 is arranged to receive ribbon which otherwise would pass directly from roller 23 to roller 24 at the left, take-up spool 12 side of the apparatus 10.

During a printing operation, it is necessary for there to be relative movement between the ribbon 13 and substrate 16, and the print head 15. The substrate 16 and ribbon 13 preferably need to be moving at the same speed relative to the print head 15 so that there is substantially no differential movement between the ribbon 13 and the substrate 16 adjacent to the print head 15.

In accordance with the invention, to achieve movement of the ribbon 13 relative to the print head 15, the shuttle 30 is moved from left to right shown in FIG. 1, from the initial position shown in FIG. 1, towards a final position shown in FIG. 2.

During such movement of the shuttle 30, which preferably is guided during its movement by respective guides g1 and g2, both the take-up spool 12 and preferably the storage spool 11 also, are maintained approximately stationary. Thus ribbon is moved past the print head 15 solely as a result of movement of the shuttle 30 along the guides g1 and g2.

Immediately prior to a printing operation, where the shuttle 30 is in the condition shown in FIG. 1, preferably the print head 15 is spaced slightly away from the ribbon 13 and substrate 16. However, before the print head 15 is made operational to remove pixels of print medium of the ribbon 13 and transfer them onto the substrate 16, the print head 15 is moved towards the roller 17 to bring the edge of the print head 15 on which the Searing elements are provided, into contact with the ribbon 13. The print head 15 is preferably maintained in this position in contact with the ribbon 13 to urge the ribbon 13 and substrate 16 towards roller 17, during the entire time for which the print heard 15 is operational.

It will be appreciated that there will be a small time required to accelerate the shuttle 30 to a desired speed during its movement i.e. to match the speeds of the substrate 16 and ribbon 13, in the direction of arrow A, and for the shuttle 30 to be decelerated from its operational speed to a stationary condition. The print head 15 may or may not be moved into its operative position closer adjacent to roller 17, during the accelerating and decelerating times of movement of the shuttle 30.

In any event, because the ribbon is moved relative to the print head during printing, by virtue of movement of the shuttle, a relatively light and constant load is imposed on a (stepper) motor driving the shuttle. Hence the acceleration and deceleration times required can be reduced to a minimum, so that the overall time taken for shuttle movement, and hence ribbon movement, can be reduced to a minimum, resulting in faster printing.

In FIG. 2, the shuttle 30 is shown at its final position at the end of a printing operation, before the print head 15 has been moved back away from the roller 17.

After a first printing operation, in accordance with one arrangement, the shuttle 30 may be returned along the guides g1 and g2 to its initial position, preferably with the print head 15 moved back away from roller 17 as described. During this movement of the shuttle 30, preferably the take-up roller 12 is rotated in a clockwise sense as seen in the drawings. It will be appreciated, that by virtue of the length of the ribbon 13 between roller 23 mounted on the base B, and the roller 31 of the shuttle, and the length of ribbon between the roller 31 of the shuttle and roller 24 mounted on the base B, that each unit of movement of the shuttle 30 from the final to the initial position will result in substantially a double length of ribbon 13 being available to he fed onto the take-up spool 12. At the same time, ribbon will be paid out from the storage spool 11 by virtue of the ribbon 13 being entrained about the roller 32 of the shuttle 30. Also, there may be substantially no movement of the ribbon 13 it the printing station 14 as ribbon is taken up onto the take-up spool 12.

Hence it will not be necessary for the motor driving take-up spool 12 to move the entire length of ribbon between the take-up 11 and storage spool 11, or for that motor to have to move the entire mass of the storage spool 11, and virtual mass provided by the drag of the idler rollers 18 to 25 mounted on the base B. The shuttle 30 will however need to be able to shift the mass of the storage spool 11 in order for ribbon 13 to be paid out from the storage spool 11 as the shuttle 30 moves from right to left, from its final to initial position.

Alternatively, subsequent to a printing operation, instead of rotating the take-up spool 12 as the shuttle 30 is moved back from its final to its initial position, thus to cause winding of the ribbon onto the take-up spool 12, the shuttle 30 may simply be returned to its initial position. It will be appreciated that in this case, as the shuttle 30 is moved back, ribbon 13 will moved back through the printing station 14, which was used in the previous printing operation. Hence in a following printing operation when the shuttle 30 is again moved from the initial to final positions, that same area of ribbon 13 will be re-used, i.e. traversed past the printing head 15.

Of course, where pixels of print medium have already been removed from the printing ribbon 13 during the first printing operation, it would not be possible to achieve satisfactory printing by trying to remove those same pixels of marking medium again.

Hence, in such an arrangement, preferably a second set of energizable heating elements are energized during the following printing operation, which may or may not include at least some of the heating elements of the first set used in the first printing operation, such that pixels of print median are transferred from the ribbon 13 onto the substrate, from different pixels positions as were removed from the ribbon 13 during the preceding printing operation.

Hence the same area of ribbon 13 may be used in a plurality of printing operations, provided that different sets of energizable heating elements are used for printing in each printing operation.

When it is desired to advance the ribbon 13 in order to present fresh ribbon to the printing station 14, the same procedure as described above may be adopted whereby the take-up spool 12 is rotated as the shuttle 30 is moved from its final to its initial position.

Various modifications may be made to the embodiment described. For example, whereas in the arrangement described the shuttle 30 is moved in a direction which is generally parallel with the direction of movement of the ribbon 13 past the print head 15, this need not be so in another arrangement. Also, the particular arrangement of rollers mounted on the base B could be changed compared to what is shown in the drawings whilst achieving movement of the ribbon past the print head 15 by movement of the shuttle 30.

In place of guide rollers, any other suitable ribbon guide means could alternatively be provided.

Preferably, the idler roller 18 comprises part of a sensing means which is able to sense the amount of ribbon which is fed from the storage spool 11 onto the take-up spool 12, during advancing of the ribbon 13.

The take-up spool 12 may for example be driven by a stepper motor so that the number of steps stepped by the motor can be controlled by a control means in response to the ribbon movement sensing means 18, to advance the ribbon 13 an accurate incremental amount. The sensing means may for example comprise the idler roller 18 which is in contact with the ribbon 13 as the ribbon 13 paid out from the storage spool 1 , and is thus rotated as the ribbon 13 moves, there being some means to determine the amount of rotation of the idler roller 18 for a given amount of ribbon movement so that rotation of the idler roller 18 can be related to the amount of ribbon movement.

For example, the idler roller 18 may carry a magnetised element with there being a magnetic sensor to sense movement of the magnetised element thus determining the amount of rotation of the idler roller, or in another example, an optical system may be provided to monitor rotation of the idler roller.

The control means may be calibrated when a full ribbon storage spool 11 is first loaded into the printing apparatus 10 when the motive means (motor) may advance a portion of the ribbon 13 onto the take-up spool 12 whilst a known amount of rotation of the take-up spool 12 caused by the motive means is related by the control means to the amount of ribbon movement sensed by the sensing means 18, and the outside diameter of the idler roller 18.

Figure 3:
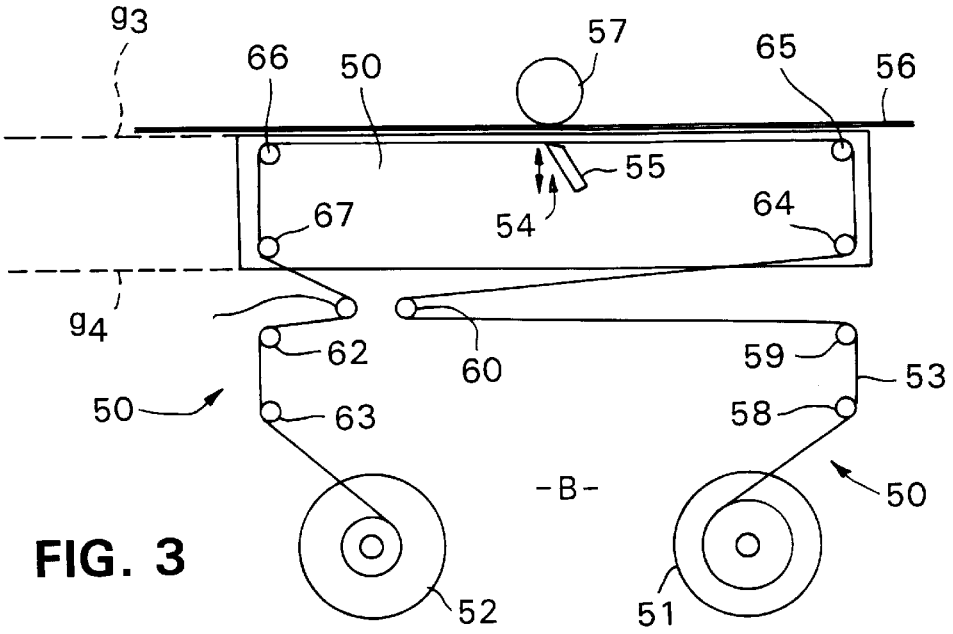
FIG. 3 is an illustrative view of a second embodiment of a printing apparatus in accordance with the invention shown in a condition immediately prior to a printing operation being performed.

Referring now to FIG. 3 there is shown an alternative embodiment of a printing apparatus 70 in accordance with the invention.

Like in the arrangement shown in FIGS. 1 and 2, there comprises a take-up spool 52 and a storage spool 51 for thermal transfer ribbon 53. A printing station 54 comprises a print head 55 of the thermal heating element type, and there is a backing roller 57 against which the print head 55 bears during a printing operation.

In this arrangement, there is provided a shuttle 50 which is adapted to be moved along guides g3 and g4 in a generally linear direction, in order to cause movement of the ribbon 53 relative to the print head 55. However in this version, the print head 55 is mounted on the shuttle 50.

Mounted on the base B' of the apparatus 70, there are a plurality of idler rollers 58, 59, 60, 61, 62 and 63 around which the ribbon 53 passes. The shuttle 50 further comprises four idler rollers 64, 65, 66 and 67 around which the ribbon 53 is also entrained.

In FIG. 3, the shuttle 50 is shown in a position prior to a printing operation being carried out on substrate 56, and the print head 55 is spaced away from the substrate 56 and the ribbon 53.

When it is desired to print, the print head 55 is moved towards the backing roller 57. In this arrangement, the printing apparatus 70 is arranged to print information on substrate 56 which is moving at a speed greater than the operational speed of the print head 55. To achieve this, during printing, not only is the substrate 56 and ribbon 53 moved relative to the base B' of the apparatus at a first speed, but also the print head 55 carried on the shuttle 50 is also moved relative to the base B' in the same direction hut at a second, slower speed. Thus the speed at which information can be printed on the substrate 56 is not limited to the operational speed of the print head 55 but faster printing speeds can be achieved depending upon the speed at which the print head 55, and shuttle 50, can be moved in the feed direction i.e. from right to left in the example shown in the drawing, including any time necessary to accelerate the print head 55 and shuttle 50 up to a speed at which the print head 55 may be operated.

The backing roller 57 is carried with the shuttle 50 or is otherwise moved in synchronism with the print head as the shuttle moves relative to the base B' so as to provide backing for the print head 55 during the entire printing stroke.

Like in the arrangement shown in FIGS. 1 and 2, preferably during such a printing operation each of the take-up 52 and storage 51 spools are maintained stationary during a printing operation such that it is only necessary to accelerate the shuttle 50 to its operational speed. Hence it is not necessary to move the mass of the storage spool 51 during a printing operation, as the ribbon 53 which is moved past the print head 55 at a greater speed relative to the base B' than the shuttle, is essentially ribbon which is already in the ribbon feed path, at least some of which will be present in a loop of ribbon entrained about idler rollers 59 and 60 of the base B', and rollers 64 and 65 of the shuttle 50, Referring to FIG. 4, the shuttle 50 is shown at its final end of print position, just prior to the print head 55 being moved back away from the backing its idler roller 57.

Figure 4:
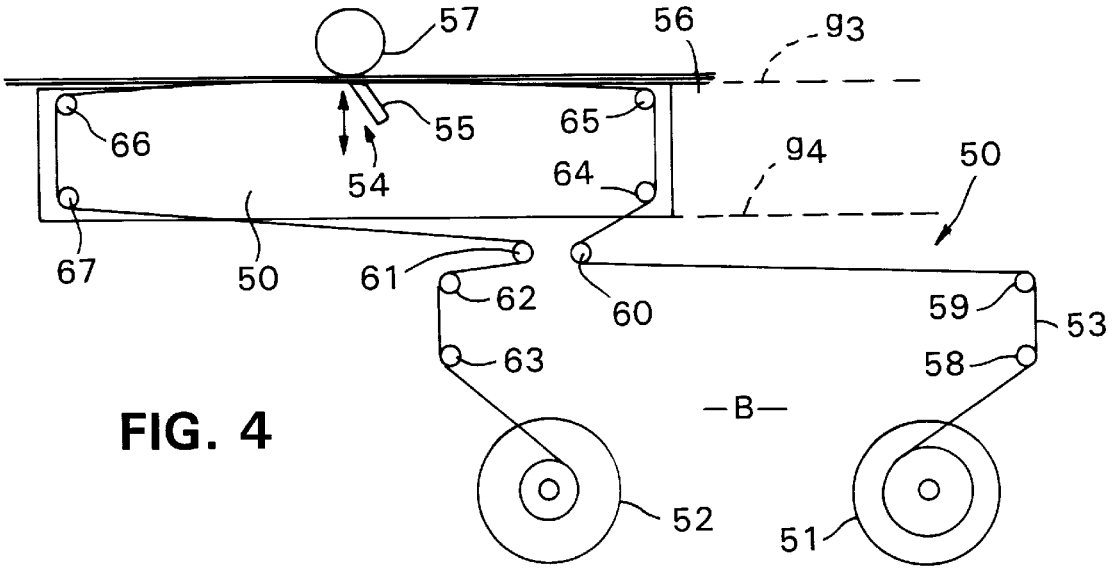
FIG. 4 is a view similar to FIG. 3 but showing the printing apparatus in a condition immediately subsequent to a printing operating being performed.

When the shuttle 50 is in the position shown in FIG. 4, either of two further steps may be taken.

First, by moving the shuttle 50 back to its initial position as shown in FIG. 3, and rotating the take-up spool 52 at the same time, or previously or subsequently, ribbon 53 will be advanced i.e. paid out from the storage spool 51 into the ribbon path, and fed onto the take-up spool 52 from the ribbon path.

As in the arrangement described in FIGS. 1 and 2, the shuttle 50 may be moved at a slower, e.g. half speed, back from the final to the initial position, whilst the take-up spool 52 is rotated. In this way, the take-up spool 52 can take up ribbon from the ribbon feed path but by moving the shuttle 50 the take-up spool 52 will not on its own, be responsible for moving the mass of the storage spool 51 so as to pay out ribbon 53 from the storage spool 51. This is achieved by virtue of a loop of ribbon 53 passing around the idler rollers 64 to 67 of the shuttle 50 and by virtue of shuttle movement being such that the pair of rollers 60, 61 mounted on the base B', closest to the shuttle 50, are always within the outermost adjacent rollers 64, 67 of the shuttle.

When the shuttle 50 has been returned to its initial position, fresh ribbon 53 will thus be available to be moved past the print head 55 as the print head 55 on the shuttle 50 moves from its initial to final position in the following printing operation.

Alternatively, when the shuttle 50 is in the position shown in FIG. 4, the shuttle 50 may simply be returned to its initial position without causing the take-up spool 52 to rotate. In this way, the same area of ribbon which was used in the previous printing operation, will be made available for reuse in the following printing operation. As described with reference to FIGS. 1 and 2, in the following printing operation, a different set of energizable heating elements of the print head 55 may be utilised during the following printing operations that were used in the first printing operation such that at least some different pixels of marking medium of the ribbon 53 are transferred from the ribbon 53 onto the substrate 56.

As with the arrangement described in FIGS. 1 and 2, an idler roller, in this case idler roller 58 which is positioned adjacent to the storage spool 51, comprises a sensing roller carrying a magnetic or optical element, with there being some sensor adjacent to the roller 58 to sense rotations of the roller 58 so that a signal can be provided to a control means which is able to calculate the amount of ribbon passing the idler roller 58 as ribbon is paid out from spool 51.

In this way, accurate control of the amount of rotation of the take-up spool 52 during ribbon 53 advance to achieve incremental ribbon movement, without waste, can be achieved.

Various modifications may be made to the arrangement described with reference to FIGS. 3 and 4 without departing from the scope of the invention. For example, the ribbon path need not comprise six idler rollers 58–63 mounted on the base B', but another arrangement may be provided. Preferably though, the shuttle 50 moves such that the uppermost pair of rollers 60 and 61 mounted on the base B' adjacent the shuttle 50, are always located between the adjacent extreme rollers 64 and 67 of the shuttle 50.

In both the embodiments described, instead of there being an idler roller 18 or 58 which senses movement of ribbon paid out from the storage spool 11 or 51, some other means for controlling the amount of ribbon movement during ribbon advance, may he provided. For example, the diameter of the ribbon wound onto the take-up spool 12 or 52 or from the storage spool 11 or 51 may he measured and a calculation made of the amount of rotation of the takeup spool 12 or 52 necessary to achieve all incremental amount of ribbon advance. In another arrangement, the ribbon feed path may include a drive roller which drives the ribbon 13, 53 to pay out ribbon from the storage spool 11, 51 such that the take-up spool 52 merely takes up any slack presented to it by virtue of the operation of that drive roller with movement of the shuttle calculated to ensure minimum strain on the ribbon 13, 53 during ribbon advance, other arrangements are no doubt possible.

Although the invention has being described with reference to a thermal type printing apparatus, the invention may be applied to ally other kind of printing apparatus where there is a ribbon carrying marking, medium which is paid out from a storage spool which passes around a ribbon feed path, and is collected by a take-up spool, although the invention has particularly application to a thermal printing apparatus for which the apparatus was specifically developed.

The substrate 16, 56 may comprise a continuous web of packaging material, individual labels on a backing web, or any other desired substrate.

In each case, the use of a shuttle 30, 50 allows a printing operation to be carried out on a substrate 16, 56 without having to provide for simultaneous paying out of ribbon from a storage spool.

The features disclosed in the foregoing description, or the following claims, or the accompanying drawings, expressed in their specific forms or in terms of a means for performing the disclosed function, or a method or process for attaining the disclosed result, as appropriate, may, separately or in any combination of such features, be utilised for recalling the invention in diverse forms thereof.

We claim:

1. A printing apparatus for printing on a substrate while the substrate is in motion, said apparatus comprising a printing station including a printhead, the substrate being moved past the printing station during a printing operation, a storage spool for printing ribbon, a ribbon take-up spool, and a shuttle moveable by a shuttle driver, said shuttle having a ribbon guide about which the ribbon is entrained so that motion of the driver, moves the ribbon past the print head during printing.

2. An apparatus according to claim 1 including a base, wherein the ribbon storage spool is mounted on the base, the ribbon take-up spool is mounted on the base, and a ribbon path extends from the storage spool to the take-up spool through the printing station, and wherein the shuttle moves relative to the base during printing and wherein during a printing operation, at least the take-up spool is maintained substantially stationary and movement between the ribbon and print head is achieved solely by means of movement of the shuttle.

3. An apparatus according to the claim 1 wherein during a printing operation the print head is maintained substantially stationary relative to the base, the shuttle being moveable relative to the print head and the base.

4. An apparatus according to claim 3 wherein the ribbon guide of the shuttle comprises a first pair of ribbon guides spaced apart a first distance, and the ribbon path is around a second pair of ribbon guides mounted on the base a second distance apart greater than the first distance, the second ribbon guides of the base being arranged such that during a printing operation the shuttle moves between the second ribbon guides of the base.

5. An apparatus according to claim 4 wherein the ribbon path is around a further pair of ribbon guides mounted on the base and spaced apart a distance greater than the first distance, the shuttle being moveable between the second ribbon guides of the base and the further ribbon guides of the base.

6. An apparatus according to claim 3 wherein when it is desired to advance the ribbon between printing operations such that fresh ribbon is available in a subsequent printing operation, the take-up spool is rotated as the shuttle is moved in an opposite sense to the direction of movement of the shuttle during a printing operation.

7. An apparatus according to claim 6 wherein to enable an incremental amount of ribbon advance to be achieved between printing operations, the length of ribbon fed during ribbon advance, is monitored by a suitable ribbon movement sensing means.

8. An apparatus according to claim 1 be wherein the print head is mounted on the shuttle so that during a printing operation, the substrate and the print head both move relative to the base.

9. An apparatus according to claim 8 wherein the print head and ribbon move in the same sense of direction relative to the base, but at different speeds so as to achieve relative movement between the print head and the ribbon.

10. An apparatus according to claim 9 wherein the shuttle comprises a first pair of ribbon guides around which the ribbon is entrained, the guides of the pair being spaced apart a first distance and the ribbon path comprising a second pair of ribbon guides mounted on the base spaced apart a second distance less than the first distance so that during a printing operation, shuttle movement is such that the second pair of guides mounted on the base are always between the first pair of ribbon guides of the shuttle.

11. An apparatus according to claim 1 wherein prior to a printing operation, the print head is moved towards the substrate, and subsequent to the printing operation the print head is moved away from the substrate along a direction traverse of the direction of movement of the shuttle.

12. An apparatus of claim 1 wherein after a first printing operation which the shuttle moves from an initial to a final position relative to the base and marking medium is removed from a first area of the ribbon and transferred onto the substrate, the shuttle is moved back to the initial position without winding ribbon onto the take-up spool such that the first area of ribbon is moved back past the print head to where it was prior to the first printing operation, so that the first area of ribbon may be re-used during a subsequent printing operation.

13. An apparatus according to claim 12 wherein the printing apparatus is a thermal type printing apparatus in which during a printing operation, pixels of marking medium are transferred from the ribbon onto the substrate by means of the print head which comprises a plurality of selectably energizable heating elements which are energized in use, a first set of heating elements being energized during the first printing operation and a second set of the heating elements being energized in a subsequent printing operation, such that pixels of marking medium are transferred from the first area of the ribbon onto the substrate during both of the printing operations.

14. The apparatus according to claim 1 wherein the apparatus includes a base, wherein the ribbon storage spool is mounted on the base, the ribbon take-up spool is mounted on the base, and a ribbon path extends from the storage spool to the take-up spool through the printing station, and wherein the shuttle moves relative to the base during printing.

15. A method of printing on a substrate while the substrate is in motion, comprising providing a printing apparatus comprising a printing station including a print head, a storage spool for printing ribbon, a ribbon take-up spool, and a shuttle moveable by a shuttle driver, said shuttle having a ribbon guide about which the ribbon is entrained, the method including the steps of; moving the substrate past the printing station during a printing operation, moving the shuttle with the driver such that the ribbon moves past the print head whilst performing the printing operation on the substrate, and maintaining at least the take-up spool substantially stationary during the printing operation.

16. The method according to claim 15 wherein the apparatus includes a base, wherein the ribbon storage spool is mounted on the base, the ribbon take-up spool is mounted on the base, and a ribbon path extends from the storage spool to the take-up spool through the printing station, and wherein the shuttle moves relative to the base during printing.

* * * * *